United States Patent [19]

Adams

[11] Patent Number: 4,739,809

[45] Date of Patent: Apr. 26, 1988

[54] HANDBAG WITH EXTERNAL POCKET FOR DISPENSING SHEET MATERIAL

[76] Inventor: Janice Adams, 3337 W. Yucca St., Phoenix, Ariz. 85029

[21] Appl. No.: 873,050

[22] Filed: Jun. 4, 1986

Related U.S. Application Data

[63] Continuation-in-part of Ser. No. 689,636, Jan. 8, 1985, abandoned.

[51] Int. Cl.[4] ..... A45C 1/02; A45C 3/06; A45C 15/04

[52] U.S. Cl. ..... 150/112; 150/52 D; 150/114; 150/117; 150/118; 206/233; 206/812; 206/818; 206/823

[58] Field of Search ..... 150/100, 106, 112, 117, 150/118, 52 D, 114, 145; 206/542, 581, 812, 818, 823, 233; D3/39, 42, 43, 48, 52, 79; 132/83 R, 79 G, 80 A; 224/237; 383/98

[56] References Cited

U.S. PATENT DOCUMENTS

| | | | |
|---|---|---|---|
| D. 33,807 | 12/1900 | Owen | D3/52 |
| D. 138,707 | 9/1944 | Fritzie | D3/52 X |
| D. 162,008 | 2/1951 | Chase | 150/52 D |
| D. 203,869 | 2/1966 | Poris | D3/52 X |
| D. 250,793 | 1/1979 | Siegel | D3/52 |
| D. 258,551 | 3/1981 | Siegel | D3/52 |
| 312,355 | 2/1885 | Johnston | 206/581 |
| 369,472 | 9/1887 | Scheuer | 206/581 |
| 1,464,176 | 8/1923 | Freund | 150/117 |
| 1,523,260 | 1/1925 | Frank | 150/106 |
| 1,607,007 | 11/1926 | Leviten et al. . | |
| 1,719,040 | 7/1929 | Barol | 150/114 X |
| 1,793,899 | 2/1931 | Benforado | 150/106 X |
| 1,959,675 | 5/1934 | Hogg | 150/106 X |
| 2,124,920 | 7/1938 | Lambooy | 132/79 |
| 2,183,428 | 12/1939 | McNary | 206/38 |
| 2,413,465 | 12/1946 | Ohlsen | 150/34 |
| 2,465,736 | 3/1949 | Marks | 150/113 X |
| 2,529,724 | 11/1950 | Conwiser | 150/34 |
| 2,612,199 | 9/1952 | Schocket | 132/79 |
| 2,675,042 | 4/1954 | Herrera | 150/112 |
| 2,784,757 | 3/1957 | Bosca et al. | 206/581 X |
| 2,937,680 | 5/1960 | Dumas | 206/581 X |
| 3,533,459 | 10/1970 | Ody | 150/34 |
| 3,927,809 | 12/1975 | Klein, Sr. | 224/237 X |
| 3,955,609 | 5/1976 | Siegel | 150/114 X |
| 4,161,201 | 7/1979 | Carp | 150/35 |
| 4,192,365 | 3/1980 | Siegel | 150/112 |
| 4,250,938 | 2/1981 | Siegel | 150/112 |

FOREIGN PATENT DOCUMENTS

| | | | |
|---|---|---|---|
| 246342 | 1/1926 | United Kingdom | 150/106 |

*Primary Examiner*—William Price
*Assistant Examiner*—Sue A. Weaver
*Attorney, Agent, or Firm*—Herbert E. Haynes, Jr.

[57] ABSTRACT

A handbag is disclosed which is essentially rectangular with a large central compartment having a top opening. Shallow internal compartments are spaced around the periphery of the opening to hold small items for easy access through the opening. In addition, flat external compartments with slots and flap closures are provided for sheet material which sheet material may be retrieved through the slots in single fashion.

20 Claims, 3 Drawing Sheets

HANDBAG WITH EXTERNAL POCKET FOR DISPENSING SHEET MATERIAL

RELATED APPLICATIONS

This application is a continuation-in-part of my copending application Ser. No. 689,636, filed Jan. 8, 1985, now abandoned.

BACKGROUND OF THE INVENTION

This invention relates generally to handbags and more particularly to a handbag with personal hygiene article holding compartments integral to the handbag in a convenient, easy accessible, discreet, and protective manner.

The primary objective of a compartmentalized handbag is to provide easy access to articles of various sizes that would find their way to the bottom and in complete disarray in a handbag with one large receptacle.

There are many organizers in the form of handbags. Prior art handbags have been designed with compartments to hold such items as wallets, checkbooks, credit cards, glasses, photographs and cosmetic items such as powder, lipstick, perfume, mascara, eyeshadow and the like. While the above items are a necessity, prior art forms have failed to provide for the additional needs necessitated by today's mobile society.

With the advent of women spending more time away from home, whether it be working, travelling, or shopping, it has become necessary to carry items such as paper toilet seat covers, sheet toilet tissue, paper towels, hand soap, air freshner, etc. to combat public facilities that are not properly equipped, maintained, or lacking in cleanliness, as well as other personal hygiene items such as hand lotion, toothpaste, toothbrush, dental floss, mouth spray, collapsible cup, etc. Many of these items can be carried in a conventional handbag, but are not readily and discreetly accessible or become damaged and thus unsuitable for their intended use.

The present invention has received wide acclaim for its unique solution of carrying the above mentioned items discreetly, while at the same time providing easy and quick access without rendering them unusable.

It is also essential to today's woman that a mirror be available at an instant for that last minute touchup before that all important interview, appointment, or date. The present invention provides an improved, convenient, and safely secured mirror.

The present invention patentably differs from U.S. Pat. No. 4,161,201, issued on July 17, 1979 to Bess Carp. Carp is not an organizer handbag, but rather a folding article organizer to be used in combination with another entity such as a carrying case.

The present invention is an integrated handbag and article organizer. The Carp Patent discloses a series of article storage compartments around the sidewalls and ends of an article organizer. One end wall provides for a series of open top storage compartments of the same width and depth.

A distinguishing feature of the present invention is the novel arrangement of the interior compartments which vary in width and depth around the periphery of the top opening of the central compartment of the handbag. This unique arrangement is not a mere matter of choice or design, but is essential to prevent articles varying in width and length from being swallowed by compartments of equal widths and depths.

The present invention provides for article holding compartments of various widths and depths to accommodate articles of various widths and lengths at a single plane which promotes quick and easy access to, as well as replacement of the articles.

Prior art structures disclosed in U.S. Pat. No. 1,719,040 issued to Barol, British Pat. No. 246,342 issued to Ortweiler, and U.S. Pat. No. 4,250,938 issued to M. I. Siegel all disclose mirrors on flaps; however, the present invention patentably differs from these prior art proposals. Barol has a flap provided with a mirror. No mention is made regarding its attachment. From the illustrations, it appears the mirror is bare and secured by glue or some other bonding material. Siegel U.S. Pat. No. 4,250,938 also shows a bare mirror.

A bare mirror would present a safety hazard to the user should it break. The present invention overcomes this problem by providing a compartment with a flat transparent sheet which not only permits viewing through to the mirror, but also keeps any broken mirror fragments from spilling out until such time they can be disposed of safely.

Ortweiler goes one step further than Barol or Siegel U.S. Pat. No. 4,250,938 by providing a mirror in a rectangular frame; however, the rectangular frame is a "cutout" and would again not prevent the mirror from shattering if broken.

Ortweiler has an opening for inserting and removing the mirror which is held intact by a flap and an elastic strip and hook.

The present invention patentably differs from Ortweiler by providing a more secure mirror compartment. The mirror is enclosed by a transparent sheet and a sealable opening utilizing a hook and loop fabric fastener such as that marketed under the Trademark Velcro which secures the opening better than a flap, thus providing a secure and safe containment of the mirror.

U.S. Pat. No. 3,955,609 issued to M. I. Siegel provides a transparent sheet on a flap. The transparent sheet has seams separating it into compartments with slits in the transparent sheet to insert and display documents, etc.

The present invention is distinguishable from Siegel U.S. Pat. No. 3,955,609 in a number of ways. The present invention has a transparent compartment formed by placing a rectangular frame over the transparent sheet and the opening is formed by not stitching the fourth side, whereas Siegel U.S. Pat. No. 3,955,609 forms its openings by slitting the transparent sheet. The compartments formed in Siegel U.S. Pat. No. 3,955,609 are used for displaying documents, etc., while the present invention uses the compartment for the safe securement of a mirror. The slits of Siegel U.S. Pat. No. 3,955,609 are open and not sealable.

The transparent mirror compartment of the present invention solves the many problems not overcome by the prior art proposals. The present invention permits the mirror to remain unattached from the flap of the handbag, but provides a secure and safe transparent compartment which permits viewing without removing the mirror. Should the mirror break, the sharp mirror fragments are contained in the compartment until such time as they can be safely disposed. A new mirror can be replaced quite readily by simply placing another mirror through the opening in the compartment and securing it with the Velcro fastener to prevent it from slipping through the opening.

The present invention provides a novel compartment with a flap for dispensing sheet material such as paper toilet seat covers and sheet toilet tissue.

U.S. Pat. No. Des. 250,793 issued to M. I. Siegel has a dispensing compartment with a small tab. The present invention patentably differs from Siegel U.S. Pat. No. Des. 250,793. When the flap of the handbag of Siegel U.S. Pat. No. Des. 250,793 is opened, the dispensing compartment is not covered thereby exposing its contents to contaminants.

The present invention overcomes the problems not solved by the prior art. A small flap is attached at the bottom of the sheet dispensing compartments. The flap not only keeps the sheet material secure, but discreetly covers it and protects it from contaminants when the flap of the handbag is in an opened position.

The point of attachment of the flap is not a matter of mere design or choice. By placing the flap at the bottom of the compartment, the handbag user's view is not obstructed when it is carried on the shoulder. Also, the flap falls away from the dispensing slot, rather than over it, which facilitates the removal of the sheet material.

Siegel U.S. Pat. No. 4,250,938 (FIG. 12), provides for an accessory in the form of a pouch with an elongated cutout and an interior pocket formed by two flaps (FIG. 13) to hold tissue papers packaged in a small pop-up container. The pouch is to be carried as a separate accessory item in a second compartment or with other handbags.

The present invention patentably differs from Siegel U.S. Pat. No. 4,250,938 in many ways. The sheet material dispenser of the present invention is not a separate entity, but rather an integral part of the handbag. The only way the tissue dispenser in Siegel U.S. Pat. No. 4,250,938 can be used is by removing the pouch from the main handbag where it is kept in a second compartment. This procedure is more cumbersome and allows the tissue to become torn and soiled, thus not sanitary.

The present invention overcomes the many problems not solved by prior art. A small flap of the present invention protects the sheet material (paper toilet seat covers and sheet toilet paper) in the dispensing compartment as well as discreetly covering it from public view when the handbag is in an opened position.

As a result of the unique flap and slotted pocket arrangement of the present invention, when the sheet material is not needed and is protruding through the slot, it is covered by the small flap so as not to be entangled, torn or contaminated. Furthermore, there is no digging around in the handbag to find the tissue holder as disclosed by Siegel U.S. Pat. No. 4,250,938.

The attachment of the flap at the bottom of the dispensing compartment of the present invention facilitates the convenient use of the sheet material since the flap falls away from the dispensing slot permitting the user an unobstructed view in the removal of the sheet material.

The unique, improved flap and slotted pocket arrangement of the present invention is not shown in prior art.

SUMMARY OF THE INVENTION

The principal object of the present invention is to provide a handbag of improved utility that overcomes the problems not solved by compartmentalized handbags of prior art.

It is an object of the present invention to provide a handbag constructed with a plurality of article holding compartments of various widths and depths, thereby providing easy access to personal hygiene articles of various sizes at the same plane.

Likewise, it is an object of the present invention to provide a handbag that will hold personal hygiene articles discreetly, separately, and securely so that such items are not damaged and rendered unusable or inadvertently retrieved causing embarrassment.

It is also an object of the present invention to provide a number of external compartments which are essentially flat and which contain folded sheet material such as paper toilet seat covers and sheet toilet tissue.

In accordance with the above object, it is a further object of the present invention to provide at least one external flat compartment having a slot for dispensing sheet material in single fashion.

It is a further object of the present invention to provide at least one protective flap covering the slot of the flat external compartment.

It is another object of the present invention to provide a flap integral with one of the sides of the handbag and having on its inside surface a transparent compartment for the safe securement of a mirror.

In accordance with the above objects, it is an object of the present invention to provide a generally rectangular handbag with an adjustable strap connected at either end allowing it to be suspended waist high for ease of access as well as providing a more secure grip against potential muggers.

Other objects and advantages of the invention will become apparent upon reading the following detailed description and upon reference to the drawings.

DETAILED DESCRIPTION OF THE INVENTION

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

Figure 1:
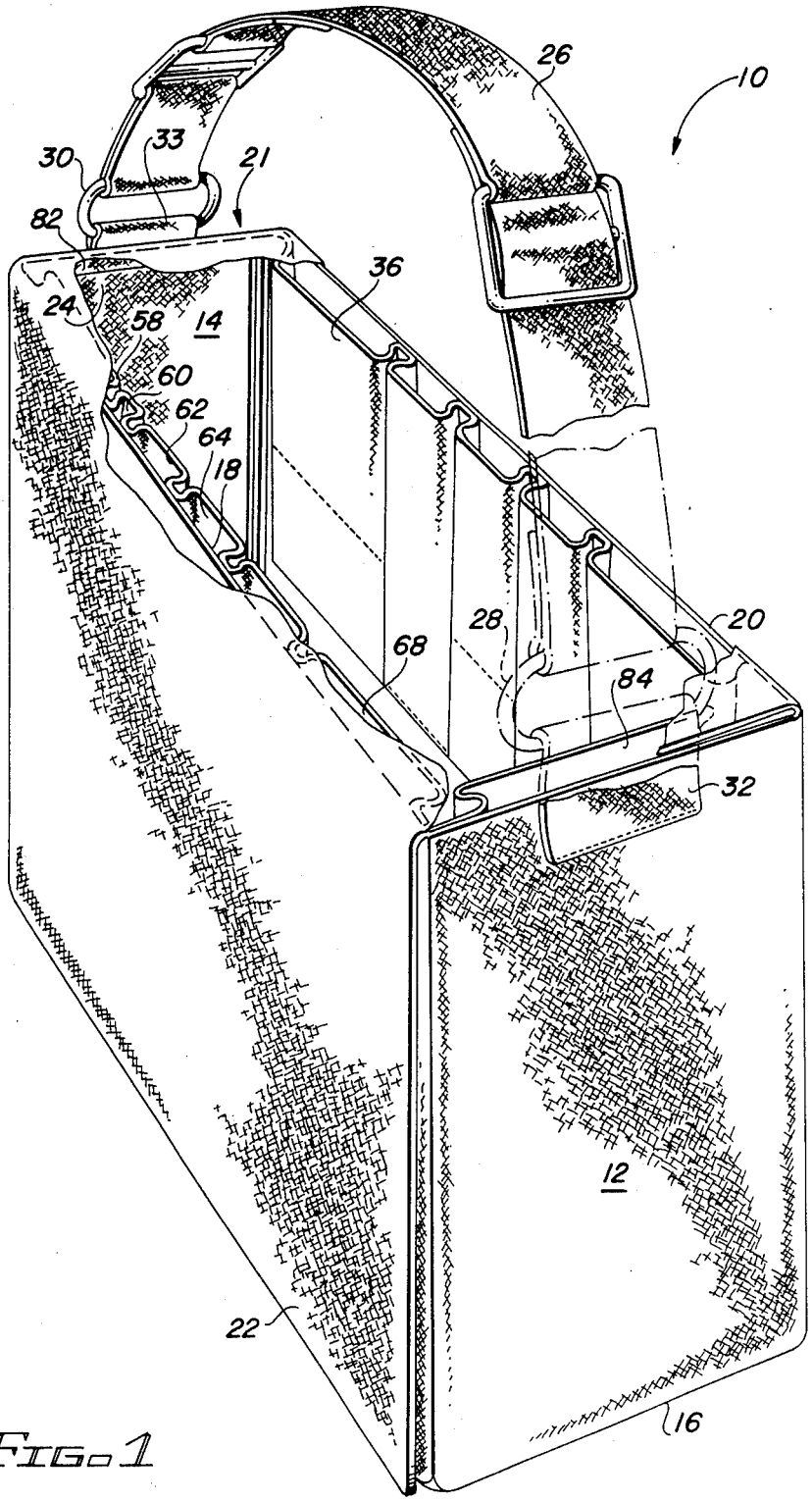
FIG. 1 is a perspective view of the handbag of the present invention.
Figure 2:
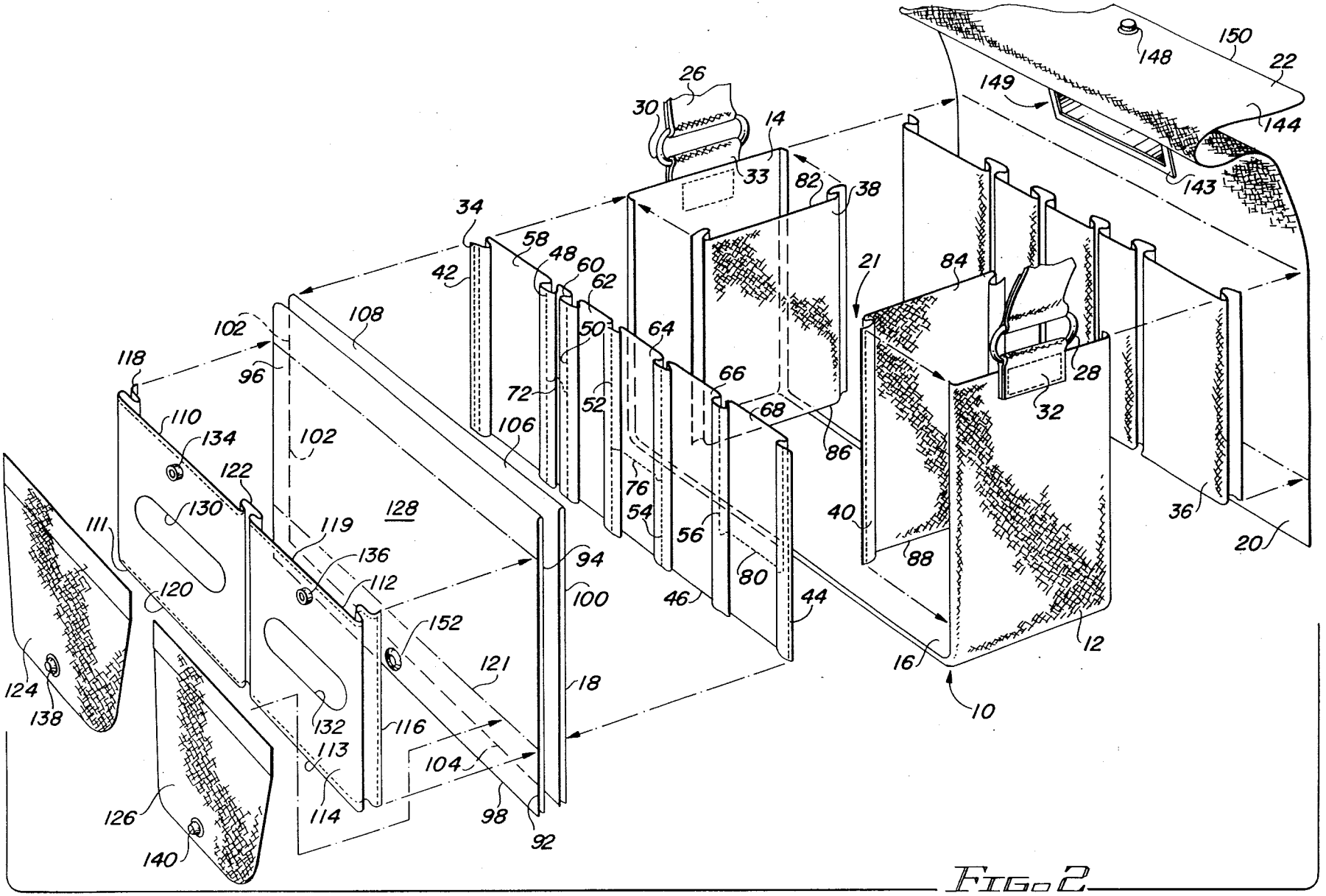
FIG. 2 is an exploded view shown from the same perspective as FIG. 1 in order to show the parts of the handbag in greater detail.

Turning to FIG. 1, there is shown a handbag 10 which is essentially rectangular. The handbag has a bottom panel 16 (FIG. 2) which has upturned ends 12 and 14 which form the end panels for the handbag. A front panel (or side wall) 18 and a back panel (or side wall) 20 (FIG. 2) are each attached to the bottom panel 16 and to the two end panels 12 and 14 to form a large central compartment 21. The back panel 20 extends above the top of the end panels 12 and 14 to form a closing flap 22 which covers the opening 24 and extends over the front of the handbag. The panels 12, 14, 16, 18, and 20 are generally formed of several layers such as an outside finished leather, an inside lining material, and perhaps a stiffening layer sandwiched between so that when the handbag is sewn together it maintains its basic rectangular shape as shown in FIG. 1. In addition and in accordance with conventional practice in the art, the stitching of the layers to each other and of internal webs to the panels is done so that the stitching does not show on the outside of the handbag. With that understanding in mind, the panels and webs will be treated for the purposes of this specification as a single web for simplicity sake.

In keeping with the present invention, a strap 26 is attached by means of rings 28 and 30 and looped tabs 32 and 33 to the end panels 12 and 14 respectively. The length of the strap 26 is adjustable so that when the handbag is suspended from the user's shoulder, the bag will be waist high for ease of access as well as providing a more secure grip against potential muggers.

The handbag has a number of internal compartments for holding various personal hygiene and cosmetic items, which compartments are easily accessible through the opening 24 of the handbag. The internal compartments are spaced around the periphery of opening 24, are of varying widths and depths, and are more shallow than the depth of the large central compartment 21. The internal compartments are formed by a front pleated web 34, a back pleated web 36, and end pleated webs 38 and 40.

The pleated web 34 (FIG. 2), for example, is sewn along its side edges 42 and 44 and along its bottom edge 46 to the inside of front panel 18. The pleated web 34 is also sewn to the front panel 18 along each of the pleats 48, 50, 52, 54, and 56. As a result, internal compartments 58, 60, 62, 64, 66, and 68 are formed between the web material 34 and the inside of the front panel 18. The widths of the internal compartments 58, 60, 62, 64, 66, and 68 are determined by the spacing between the pleats 48, 50, 52, 54, and 56. The widths and depths of the internal compartments are selected to accommodate specific personal hygiene items which would be useful when confronted with using public facilities.

In order to achieve the full advantage of the present invention, not only should each item have its own compartment of appropriate width, but also the depth of each compartment should be varied to accommodate various article sizes and should be more shallow than the depth of the central compartment. Therefore, when an item is placed in the internal peripheral compartment, it will not disappear into the depths of the internal compartment, but will be retained near the top of the opening 24 of the handbag. Because the web 34 is narrow and not as deep as the large central compartment 21, the internal compartments will have a maximum depth defined by bottom edge 46 of the web 34. In order to provide compartments that are even more shallow than the depth of web 34 (for smaller items), the web 34 can be stitched to panel 18 across the bottom of each internal compartment at the desired height above line 46 as illustrated by stitch lines 72, 76, and 80. As a result, each of the compartments 58, 60, 62, 64, 66, and 68 can have its own individual depth, which depth is selected to accommodate the particular personal hygiene item that fits in that compartment to thereby assure that the item is retained near the top of the compartment and thus easily accessible through opening 24 of the handbag.

Internal peripheral compartments 82 and 84 are likewise formed by attaching pleated webs 38 and 40 to the end panels 14 and 12 respectively. The depths of compartments 82 and 84 are determined by the size of the item to be held. Specifically, the bottom edges 86 and 88 define the maximum depths of compartments 82 and 84 respectively.

A back pleated web 36 is likewise attached to the inside of back panel 20 of the handbag to create similar peripheral internal compartments of varying depths and widths along the back panel to assure that the personal hygiene items may be retained in those compartments near the top opening 24 of the handbag for easy access.

As can best be seen from FIG. 1, the opening 24 has arranged around its periphery a number of individual internal compartments each of predetermined width and depth to assure that each selected personal hygiene item has its own internal compartment thereby rendering each immediately available to the handbag user near the top opening 24. The large central compartment 21 can be used to store larger items such as checkbooks, wallets, sunglasses, and the like.

In order to provide convenient storage for sheet materials such as paper towels or other flat items, a flat external pocket 106 with an opening 108 is formed by attaching a second front panel 92 along its side edges 94 and 96 and along its bottom edge 98 to the respective side edges 100 and 102 and bottom edge 104 of the outside of front panel 18.

Figure 3:
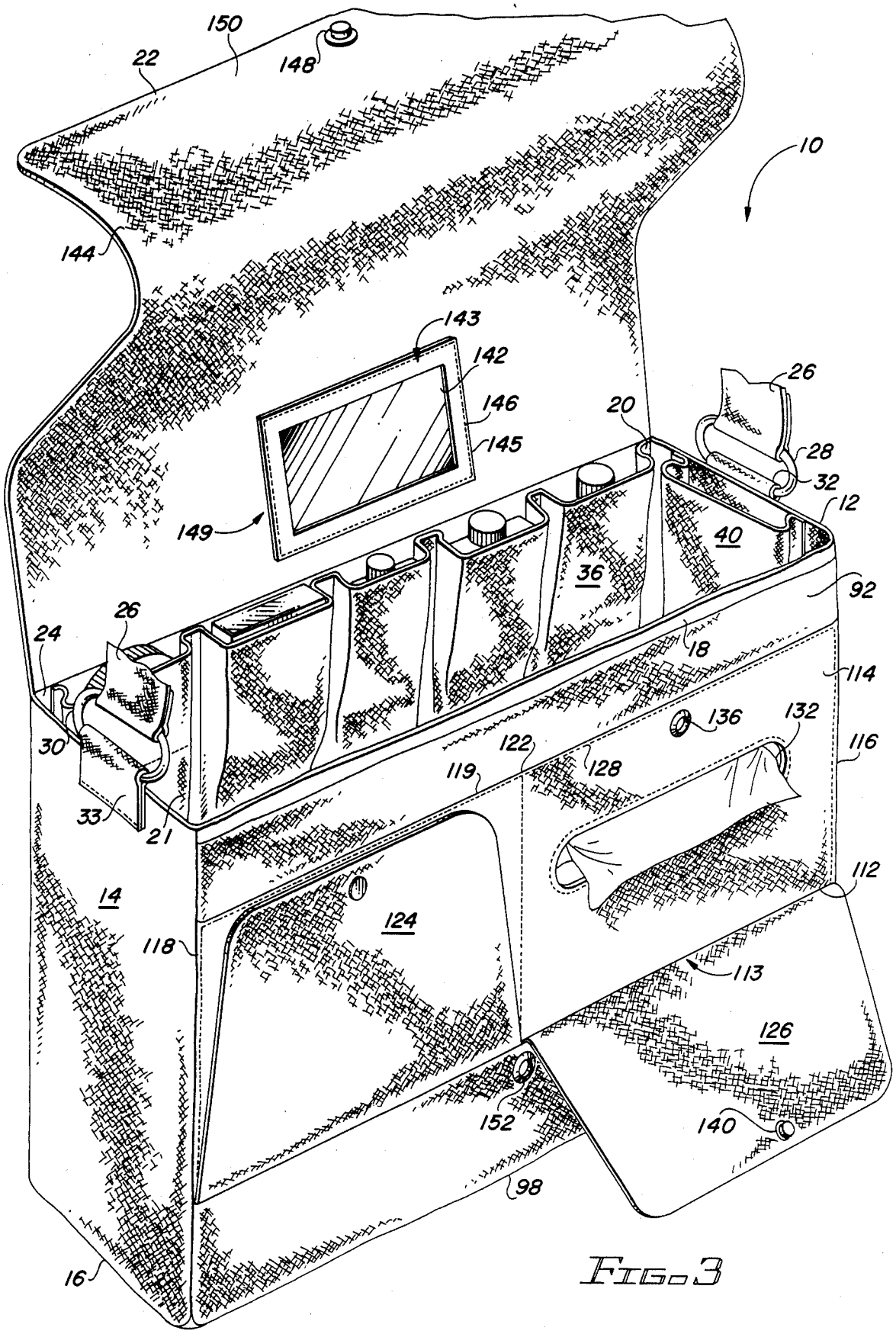
FIG. 3 is a perspective view generally corresponding to FIG. 2 illustrating the plurality of article holding compartments of various widths and depths and the external compartment for dispensing sheet material in single fashion.

In order to provide further convenient storage for certain kinds of sheet items such as paper toilet seat covers or sheet toilet tissue (FIG. 2 and 3), two further external compartments 110 and 112 are formed by attaching a pleated web 114 along its side edges 116 and 118 to the outside of second external panel 92 adjacent its respective side edges 94 and 96. The pleated web 114 is also attached at its top 119 along line 128 to the outside of second panel 92 with its bottom edge 120 being loose, i.e. not attached. The lower and upper edges 120 and 119 respectively, of pleated web 114 are displaced from the lower and upper edges of the second external panel 92. The web 114 is also attached along its pleat 122 to the second external panel 92. As a result, compartments 110 and 112 are formed with bottom openings 111 and 113. A pair of flaps 124 and 126 are sewn to panel 92 along line 121 which line is adjacent the bottom openings 111 and 113 of the compartments 110 and 112.

The web 114 has horizontal slots 130 and 132 which allow access into compartments 110 and 112. Adjacent to and above each of the slots are magnetic closure means 134 and 136 which engage associated magnetic closure means 138 and 140 attached to the internal side of flaps 124 and 126 respectively.

Sheet material such as paper toilet seat covers or sheet toilet paper can be inserted into compartments 110 and 112 through bottom openings 111 and 113. The flaps 124 and 126 can then be folded up over the openings 111 and 113 and over the slots 130 and 132 and connected respectively to the magnetic closures 134 and 136 by means of complementary closures 138 and 140. In order to have access to the sheet material in compartments 110 and 112, the user simply opens flap 124, for example, by disengaging the magnetic closures 134 and 138 and allowing the small flap to fall back providing a clear view of the protruding sheet material, then pulls the unobstructed sheet material through the slot 130 in single fashion.

A rectangular piece of transparent material 142 with an opaque border 143 is attached to the inside lining 144 along three edges at the lower end of flap 22, directly above panel 20 forming a flat compartment 149 for the containment of a mirror. The opening 145 formed by the unattached edge 146 permits the insertion and removal of a mirror. The opening 145 is conveniently sealed with a Velcro closure, thus not only preventing the mirror from sliding out but keeping it safely contained if broken.

The mirror compartment 149 is positioned on the lower stiffened section of flap 22 to provide convenient viewing when flap 22 is opened. With flap 22 in its closed position, the mirror compartment 149 is positioned over opening 24 of the handbag. Thus, it is essential that the mirror be safely secured by the transparent material to prevent possible breakage.

The flap 22 also has a magnetic closure 148 attached near its bottom edge 150 which attaches to its associate closure 152, secured to the outside of front panel 92 near its bottom edge 98. The flap is folded over the top opening 24 and front panel of the handbag and secured by means of magnetic closures 148 and 152 in order to cover the opening 24 and the flaps 124 and 126.

I claim:

1. A handbag structure comprising:

(a) a handbag having a front panel, a back panel, an opposed pair of end panels and a bottom panel which cooperatively define a central compartment with a top opening;

(b) a first web of material in the central compartment of said handbag and disposed to extend around at least a portion of the periphery of the top opening of said handbag, said first web being elongated and secured inside the central compartment of said handbag at various locations transverse to said first web and at various locations relative to the bottom edge of said first web to provide a plurality of open top internal pockets of various depths and widths;

(c) a second web of material extending across at least a portion of the outside surfaces of the front panel of said handbag, said second web having a top edge, a bottom edge and opposed side edges with the top and side edges being secured to the front panel of said handbag to provide at least one external pocket having an open bottom, said second web having a slot therein for dispensing sheet materials; and (d) small flap means secured to the front panel of said handbag adjacent the open bottom of the external pocket formed by said second web and extending upwardly for closing the bottom opening and the slot of the external pocket formed by said second web.

2. A handbag as claimed in claim 1 and further comprising fastener means for releasably holding said small flap means in its upwardly extending position.

3. A handbag as claimed in claim 1 and further comprising a large flap extending from the upper edge of the back panel of said handbag, said large flap having a first portion for selectively covering the top opening of the central compartment defined by said handbag and a second portion for selectively overlaying and covering the external pocket formed by said second web and said small flap means.

4. A handbag as claimed in claim 3 and further comprising:

(a) said first portion of said large flap having an inside surface;

(b) a flat transparent sheet of substantially rectangular configuration and having three edges attached to the inside surface of said first portion of said large flap to form a compartment having an open edge for containment of a mirror; and (c) means for releasably sealing the open edge of the compartment formed by said flat transparent sheet.

5. A handbag structure comprising:

(a) a handbag defining a central compartment with an open top, said handbag having a front panel;

(b) a web of material extending across a portion of the outside surface of the front panel of said handbag and having a top edge, a bottom edge and an opposed pair of side edges with the top and side edges being secured to the front panel of said handbag to form at least one pocket having an open bottom end for containment of sheet materials, said web having a slot formed therein for dispensing the sheet materials; and (c) small flap means secured to the front panel of said handbag adjacent the open bottom end of the pocket formed by said web and extending upwardly for selective closing of the open bottom end and the slot of the pocket formed by said web.

6. A handbag structure as claimed in claim 5 and further comprising means for releasably holding said small flap means in the upwardly extending position thereof.

7. A handbag structure as claimed in claim 5 and further comprising:

(a) said handbag having a back panel with an upper edge; and (b) a large flap extending from the upper edge of said back panel of said handbag for selective covering of the open top of the central compartment of said handbag and covering the pocket formed by said web and said small flap means.

8. A handbag structure as claimed in claim 7 wherein said large flap has a first portion for selectively covering the open top of the central compartment of said handbag and a second portion for selectively covering the pocket formed by said web and said small flap means.

9. A handbag structure as claimed in claim 8 and further comprising:

(a) said first portion of said large flap having an inside surface;

(b) a transparent sheet of substantially rectangular configuration with three edges thereof being attached to the inside surface of the first portion of said large flap to form a mirror containment compartment having one open edge; and (c) means for releasably closing the one open edge of the mirror containment compartment formed by said transparent sheet.

10. A handbag structure as claimed in claim 9 wherein said transparent sheet has an opaque border.

11. A handbag structure as claimed in claim 5 and further comprising a second web of material in the central compartment of said handbag and disposed to extend around at least a portion of the central compartment defined by said handbag, said second web being elongated and secured inside the central compartment of said handbag at various locations transverse of said second web and at various locations relative to the bottom edge of said second web to form a side-to-side plurality of open top pockets of various widths and depths.

12. A handbag structure as claimed in claim 11 wherein said second web is located in the central compartment of said handbag in a position wherein the open tops of the side-by-side pockets formed by said second web are aligned with each other and are spaced slightly below the open top of the central compartment defined by said handbag.

13. A handbag structure comprising:

(a) handbag defining a central compartment with an open top, said handbag having a front panel;

(b) a web of material extending across a portion of the outside surface of the front panel of said handbag and having a top edge, a bottom edge and an opposed pair of side edges with all but one of said top, bottom and side edges being secured to the front panel of said handbag to form at least one pocket having an open edge for receiving and containing sheet material, said web having a slot formed therein for dispensing the sheet materials; and (c) small flap means secured to the front panel of said handbag adjacent the bottom edge of said web and extending upwardly for selectively covering at least said slot.

14. A handbag structure as claimed in claim 13 and further comprising means for releasably holding said small flap means in the upwardly extending position thereof.

15. A handbag structure as claimed in claim 13 and further comprising:

(a) said handbag having a back panel with an upper edge; and (b) a large flap extending from the upper edge of said back panel of said handbag for selectively covering the open top of the central compartment of said handbag and covering the pocket formed by said web and said small flap means.

16. A handbag structure as claimed in claim 13 wherein said large flap has a first portion for selectively covering the open top of the central compartment of said handbag and a second portion for selectively covering the pocket formed by said web and said small flap means.

17. A handbag structure as claimed in claim 16 and further comprising:

(a) said first portion of said large flap having an inside surface;

(b) a transparent sheet of substantially rectangular configuration with three edges thereof being attached to the inside surface of the first portion of said large flap to form a mirror containment compartment having one open edge; and (c) means for releasably closing the one open edge of the mirror containment compartment formed by said transparent sheet.

18. A handbag structure as claimed in claim 17 wherein said transparent sheet has an opaque border.

19. A handbag structure as claimed in claim 13 and further comprising a second web of material in the central compartment of said handbag and disposed to extend around at least a portion of the central compartment defined by said handbag, said second web being elongated and secured inside the central compartment of said handbag at various locations transverse of said second web and at various locations relative to the bottom edge of said second web to form a side-to-side plurality of open top pockets of various widths and depths.

20. A handbag structure as claimed in claim 19 wherein said second web is located in the central compartment of said handbag in a position wherein the open tops of the side-by-side pockets formed by said second web are aligned with each other and are spaced slightly below the open top of the central compartment defined by said handbag.

* * * * *